US005283961A

United States Patent [19]

Gobel

[11] Patent Number: 5,283,961

[45] Date of Patent: Feb. 8, 1994

[54] TRAMP REMOVAL SYSTEM

[75] Inventor: Richard J. Gobel, Scappoose, Oreg.

[73] Assignee: Beloit Technologies, Inc., Wilmington, Del.

[21] Appl. No.: 863,929

[22] Filed: Apr. 6, 1992

[51] Int. Cl.[5] ..... F26B 11/02

[52] U.S. Cl. ..... 34/136; 34/141; 110/226

[58] Field of Search ..... 34/130, 131, 135, 136, 34/141, 142; 110/226, 110; 432/103, 117, 118

[56] References Cited

U.S. PATENT DOCUMENTS

| | | | |
|---|---|---|---|
| 832,961 | 10/1906 | Elkus | 34/136 |
| 2,171,535 | 9/1939 | Berg et al. | 110/226 |
| 2,878,584 | 3/1959 | Bianchi | 34/136 |
| 3,058,229 | 10/1962 | Downing | 34/136 |
| 4,376,343 | 3/1983 | White et al. | 110/226 |

FOREIGN PATENT DOCUMENTS

| | | |
|---|---|---|
| 408830 | 5/1935 | Belgium . |
| 686028 | 2/1940 | Fed. Rep. of Germany . |
| 961698 | 4/1957 | Fed. Rep. of Germany . |
| 976218 | 5/1963 | Fed. Rep. of Germany . |

*Primary Examiner*—Henry A. Bennet
*Assistant Examiner*—Denise L. Gromada
*Attorney, Agent, or Firm*—Dirk J. Veneman; Raymond W. Campbell

[57] ABSTRACT

An apparatus for collecting foreign materials such as rocks and tramp iron from material fed to a rotary dryer, wherein the material is dropped into the dryer at an intake end for tumbling within the dryer in a stream of drying gas flowing axially through the dryer. A trough is positioned spaced downwardly and beneath the intake for catching the heavy foreign materials dropping downwardly, and the foreign materials are carried outwardly by a screw auger driven by the dryer.

18 Claims, 1 Drawing Sheet

TRAMP REMOVAL SYSTEM

BACKGROUND OF THE INVENTION

The present invention relates to improvements in rotary drying systems, and more particularly to an improved hog fuel dryer wherein contamination of the fuel such as rocks and foreign material are removed so that they will not be transported through the dryer and cause damage.

Dryer systems are used for many purposes, including drying sludge prior to disposal, drying crops prior to further processing and drying fuel prior to combustion.

Fuel drying systems are widely used, and the interest in such systems results from the proven fact that dry fuel increases boiler efficiency. Drying of the fuel prior to being supplied to a boiler is highly advantageous in that if the drying is done inside the boiler, some of the energy which could be used to generate steam is instead consumed to dry incoming fuel. Boilers are inefficient dryers and the effect of wet fuel on the boiler performance is dramatic. Drying fuel in advance of the boiler results in more available BTU's per pound of fuel, as well as increased boiler efficiency. Drying also allows the effective control of fuel moisture content as moisture varies by season and with the composition of raw material. The consistency of the fuel moisture also contributes to more efficient and predictable boiler performance.

A commonly used fuel dryer operates on the rotary principle, wherein a rotary drum is fed with the fuel, and heated gases remove moisture from the fuel. Such a dryer can increase boiler efficiency by 10% or more. For example, if fuel is burned at a 55% moisture content in a boiler with a 500° F. flue gas temperature, drying can be conducted to substantially reduce the moisture to combustion sustaining levels. If the moisture content of the fuel is reduced from 55% to 33%, the boiler efficiency will increase from approximately 57% to about 68%, thereby increasing boiler efficiency by more than 10%.

Rotary dryers are used commonly to dry fuel in industries such as the pulp and papermaking industry. In such industry, naturally occurring fuel, such as hog fuel, is widely available, and such fuel often becomes contaminated with rocks and foreign material. If the rocks and foreign material are permitted to enter a rotary dryer, extensive damage can result to flights and other internal components of the dryer. Since the material being dried is carried, at least in part, by the airstream through the dryer, the foreign elements, which are often much heavier than the fuel, cannot otherwise get out of the drum, due to the nature of the dryer construction. The foreign material tumbles the length of the dryer or concentrates in one area, in either case being tumbled at length by the dryer vanes or flights. Large or heavy foreign material, such as rocks, can cause significant damage, while being tumbled in the dryer.

FEATURES OF THE INVENTION

An object of the present invention is to provide an improved rotary dryer which can utilize effective drying principles, and which is provided with an improved means for removing foreign elements such as rocks and tramp iron.

A still further object of the invention is to provide an improved arrangement for the removal of tramp iron and rocks from a rotary dryer wherein the foreign elements are transported from the dryer by conveyor means driven by the rotary drum, and the foreign materials are removed from the system in an improved manner through related removal means.

Another object of the present invention is to provide a foreign material removal apparatus for a rotary dryer which can remove the foreign material as it first enters the dryer, before significant damage is caused.

In accordance with the features of the invention, a large, horizontally positioned, tubular dryer shell is mounted for rotation with an intake at one end for the material to be dried. At the intake, the material is dropped gravitationally where it is met by a flow of drying gases. The material to be dried is carried forward by the flow of drying gases, and heavier foreign elements such as rocks and tramp iron drop into a trough which is controllable as to its opening size and is provided with a conveyor for delivering the foreign elements away from the dryer. The conveyor is driven by rotation of the dryer shell so that separate power means are not required. The foreign elements are dropped down a drop leg and fed through a gas seal for removal. The material to be dried can then be fully treated in a unique manner in the dryer shell, being handled and tumbled in such a manner which would not be possible if the foreign elements were not removed.

Other objects, advantages and features of the present invention will become more apparent with the teaching of the principles of the invention in connection with the disclosure of the preferred embodiments thereof in the specification, claims and drawings, in which:

DESCRIPTION OF THE PREFERRED EMBODIMENTS

Figures 1, 2:
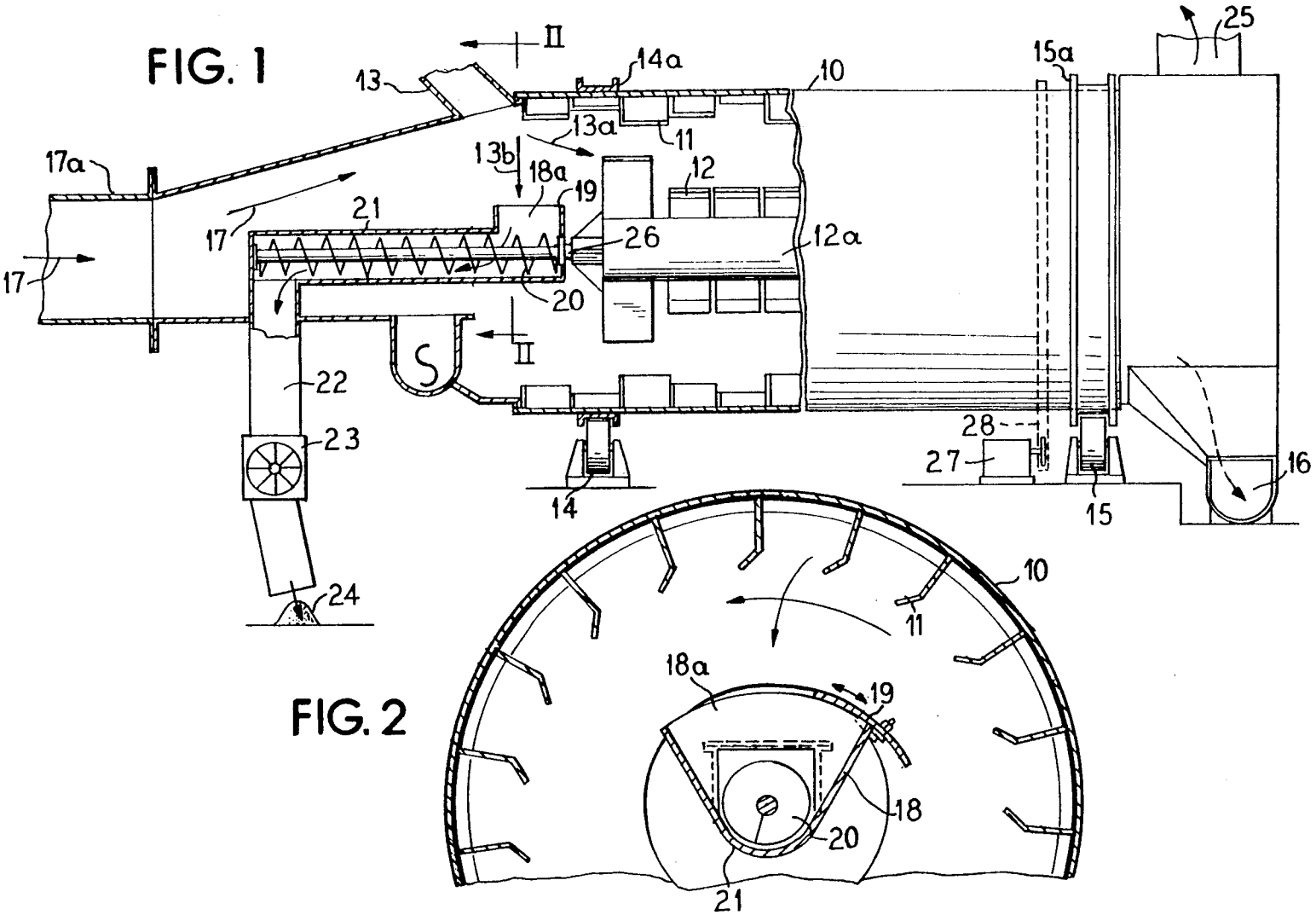
FIG. 1 is an elevational view shown partially in vertical section of a rotary dryer constructed and operating in accordance with the principles of the present invention.
FIG. 2 is a fragmentary sectional view taken substantially along line II—II of FIG. 1.

FIGS. 1 and 2 illustrate a large rotary drum dryer having a dryer shell 10 within which material is dried. The shell is hollow and tubular in shape, and is rotatable about a horizontal axis, being supported at its ends by a plurality of support rollers 14 and 15 which run in channels 14*a* and 15*a*, respectively.

The invention will be described herein with respect to a hog fuel dryer; however, it should be recognized that the present invention is useful in rotary dryers regardless of the material being dried, and is not limited in its scope to use in a hog fuel dryer. The invention is believed to be especially useful for hog fuel dryers, in that hog fuel is particularly susceptible to contamination from rocks and tramp material as a result of typical procedures for obtaining, storing and handling hog fuel.

Within the shell 10 are tumbling vanes 11 on the shell wall, to guide the fuel in its drying movement within the shell. Also, located within the shell are centrally located vanes 12 on a center shaft 12*a*, which create movement and tumbling for the fuel being carried therein. The shapes and arrangements of the vanes, both on the shell and the center shaft, are chosen to give the desired tumbling action and retention of the material being dried.

A flow of heated gases, as indicated by arrows 17, is provided to the dryer from a pipe or conduit 17*a* to pass through the hog fuel in the shell and remove moisture from the fuel, which moisture flows out with the gases at an exhaust location 25. Some of the gases leaving at the exhaust location 25 may be recycled to the inlet flow at 17. The dried fuel is discharged at the discharge end of the dryer into a fuel conveyor 16.

The shell is driven in rotation by a motor 27 having a driving belt 28. Other drive means also may be used, including driving one or more of the rollers 14 and 15 on which the dryer rests, or the use of a motor driven drive chain engaging teeth on the drum.

Fuel to be dried is delivered to the shell at an intake end at 13. As the fuel drops downwardly, it is carried axially along the drum by the flow of gases as indicated by the arrowed line 13*a*. Foreign elements such as rocks and tramp iron, because of their weight, drop downwardly as indicated by the arrowed line 13*b*. Thus, an initial separation occurs at the dryer inlet area, between the material which is influenced by the gas stream and the heavy tramp material which is not influenced. The present invention takes advantage of this separation, by providing a trough 18 positioned beneath the intake 13, the trough having a trough opening 18*a*. The trough is shaped and positioned to capture the tramp material falling in the path 13*b*. As illustrated in FIG. 2, the trough has an adjustable door 19, which can control the size of the trough opening 18*a*. In some instances, it may be desirable also to make the trough adjustable in axial location, so as to further improve the capturing of the foreign elements, while limiting the amount of fuel material which enters the trough.

As the foreign elements drop into the trough 18, they are carried axially by a rotary screw conveyor having an auger 20 within a tube 21. The foreign elements are carried axially away from the shell 10 to a drop leg 22, where they fall downwardly to pass a gas seal 23 and into a collection pile 24. The gas seal elements 23 may be in the form of a slide gate or rotary valve to pass the tramp iron and rocks but provide a gas seal.

A feature of the invention is the driving of the auger 20 by the rotation of the shell 10, and at the same speed as the rotation of the drum. For this, the center shaft 12*a* within the drum, which is rotatable with the drum, is connected at 26 to the auger 20, so that the auger is driven in rotation to carry the foreign elements axially away from the trough 18.

In operation, fuel to be dried is fed at a controlled rate, such as by a conveyor, into the intake 13 to drop downwardly. Heated gases flowing, as indicated by the arrowed lines 17, carry the fuel forwardly axially as indicated by the arrowed line 13*a* into the dryer shell. The heavier foreign elements, such as rocks and tramp iron, which are not influenced significantly by the heated gas stream, drop vertically downwardly as indicated by the arrowed line 13*b* into the trough 18. The trough feeds to the auger 20 driven by the rotation of the shell 10 and center shaft 12*a*, so that the foreign elements are moved to the drop leg 22, where they pass through a gas seal 23 to be deposited at 24 for removal.

Thus, it will be seen that there has been provided an improved rotary dryer apparatus for removing foreign elements carried into the dryer along with the material to be dried, to enable full utilization of an efficient rotary dryer.

I claim as my invention:

1. A tramp removal system for a rotary dryer comprising in combination:

an elongate, substantially horizontal tubular dryer shell mounted for rotation and having an intake location and a discharge location in the shell;

a drive and rotary support means for carrying the shell in rotation about a longitudinal axis;

means defining a material intake at said intake location for depositing material to be dried into the shell;

means directing a flow of drying gas through the shell the gas flowing from the intake location, past the material intake to the discharge location;

a collection trough means for separating tramp material from the material to be dried, said collection trough means including an upwardly facing trough opening near to and below said material intake, said opening being positioned and shaped for receiving heavy, foreign, tramp material including rocks and tramp iron falling downwardly into the trough separate and apart from the material to be dried; and conveying means associated with said trough for conveying said foreign, tramp material from the trough to the exterior of the shell.

2. A tramp removal system for a rotary dryer constructed in accordance with claim 1:

wherein said conveying means is a screw conveyor carrying the foreign, tramp material.

3. A tramp removal system for a rotary dryer constructed in accordance with claim 2:

wherein the screw conveyor has an auger driven in rotation with the dryer shell.

4. A tramp removal system for a rotary dryer constructed in accordance with claim 1:

wherein said conveying means conveys the foreign, tramp material to a drop leg where the foreign, tramp material drops for collection exteriorly of the shell.

5. A tramp removal system for a rotary dryer constructed in accordance with claim 1:

wherein the conveying means leads to a seal for passing the foreign, tramp material exteriorly of the shell.

6. A tramp removal system for a rotary dryer constructed in accordance with claim 5:

wherein said seal includes a gas sealed chamber through which the foreign, tramp material is carried.

7. A tramp removal system for a dryer constructed in accordance with claim 5:

wherein said seal includes a rotary valve through which the foreign, tramp material is carried.

8. A tramp removal system for a rotary dryer constructed in accordance with claim 1:

wherein the intake location is at one end of the rotary shell and the discharge location is at an opposite end of the shell.

9. A tramp removal system for a rotary dryer constructed in accordance with claim 1:

including means for adjusting the position of said collection trough, to position the trough in an optimum position relative to the flow of drying gas and material in the dryer.

10. A tramp removal system for a rotary dryer constructed in accordance with claim 1:

wherein the size of the trough opening at the top of the trough is adjustable.

11. A tramp removal system for a rotary dryer constructed in accordance with claim 10:

wherein said conveying means is a screw conveyor carrying the foreign, tramp material.

12. A tramp removal system for a rotary dryer constructed in accordance with claim 11:

wherein the screw conveyor has an auger driven in rotation with the dryer shell.

13. A dryer and foreign material removal system for the dryer comprising in combination:

an elongate tubular dryer shell mounted for rotation and having projections within the shell for tumbling material therein;

means for driving the shell in rotation;

a material intake location at an upper portion at one end of the shell and a discharge location at an opposite end of the shell, with means for carrying away dried material;

a center shaft having material engaging projections and extending through the shell, for aiding in the tumbling of the material, said center shaft being driven in rotation with the shell;

an upwardly facing trough located spaced beneath the material intake and positioned so that foreign material, including rocks and tramp iron, fall downwardly into the trough;

an auger leading from the trough and connected to the center shaft so as to be driven in rotation by the center shaft, for carrying away the foreign material;

an adjustable opening for the trough;

a drop leg at the end of the auger for receiving the foreign material;

a gas seal at the end of the drop leg for passing the foreign material and limiting the escape of gases;

a gas delivery means at the intake end of the shell delivering a flow of gas past the intake and through the material tumbling within the shell;

and support rollers at each end of the shell supporting the shell in rotation.

14. In a rotary dryer apparatus having an elongate, tubular dryer shell mounted for rotation, means for driving the shell in rotation, a center shaft extending through the shell and being driven in rotation with the shell, material engaging fights disposed on the shell and the center shaft for engaging and tumbling material in the dryer, a material inlet and a material outlet in the shell, and a heated gas supply means for conducting heated gases through the shell to dry material tumbled in the shell, the improvement comprising:

receiving means disposed beneath the material inlet for capturing foreign material supplied to the dryer in a flow of material to be dried, said receiving means being adapted to receive the foreign material while minimizing the reception of material to be dried; and transfer means for transporting out of the dryer foreign material captured in said receiving means.

15. The improvement for a rotary dryer as defined in claim 14 further comprising:

said receiving means being a trough disposed beneath said material inlet.

16. The improvement for a rotary dryer as defined in claim 15;

in which a screw conveyor operates with said trough for transporting foreign material out of the dryer.

17. The improvement for a rotary dryer as defined in claim 15:

in which said trough includes adjustment means for controlling an opening to the trough.

18. The improvement for a rotary dryer as defined in claim 17:

in which a screw conveyor is drivingly connected to said center shaft and is cooperatively disposed with respect to said trough for receiving foreign material captured by the trough and transporting the foreign material out of the dryer.

* * * * *